United States Patent [19]

Ii

[11] Patent Number: 4,546,923

[45] Date of Patent: Oct. 15, 1985

[54] NOZZLE FOR ATOMIZING FLUIDS

[76] Inventor: Tadashi Ii, 24-13, Omori Higashi 1-chome, Ota-ku, Tokyo 143, Japan

[21] Appl. No.: 644,646

[22] PCT Filed: Mar. 24, 1981

[86] PCT No.: PCT/JP81/00061

§ 371 Date: Jul. 28, 1982

§ 102(e) Date: Jul. 28, 1982

[87] PCT Pub. No.: WO82/01831

PCT Pub. Date: Jun. 10, 1982

Related U.S. Application Data

[63] Continuation of Ser. No. 403,741, Jul. 28, 1982, abandoned.

[30] Foreign Application Priority Data

Nov. 29, 1980 [JP] Japan ..... 55-170286

[51] Int. Cl.[4] ..... B05B 7/10

[52] U.S. Cl. ..... 239/406; 239/433

[58] Field of Search ..... 239/403–406, 239/433, 472, 474, 475, 487–489

[56] References Cited

U.S. PATENT DOCUMENTS

| | | | |
|---|---|---|---|
| 2,661,195 | 12/1953 | van Bemmel et al. | 261/30 |
| 2,878,065 | 3/1959 | Watkins | 239/404 |
| 3,887,135 | 6/1975 | Tamai | 239/406 |
| 3,915,387 | 10/1975 | Caruel et al. | 239/404 X |
| 4,216,908 | 8/1980 | Sakurai et al. | 239/132.3 |
| 4,274,812 | 6/1981 | Elvidge et al. | 239/433 X |

FOREIGN PATENT DOCUMENTS

| | | | |
|---|---|---|---|
| 679142 | 9/1952 | United Kingdom . | |
| 1016333 | 1/1966 | United Kingdom | 239/404 |
| 0895526 | 1/1982 | U.S.S.R. | 239/406 |

*Primary Examiner*—Andres Kashnikow
*Assistant Examiner*—James R. Moon, Jr.
*Attorney, Agent, or Firm*—Flynn, Thiel, Boutell & Tanis

[57] ABSTRACT

A nozzle for atomizing or discharging a liquid, particles, powder or the like in a uniform and stable state without disturbance, utilizing a rotating air current of low wind pressure, low velocity and low flow rate. A working fluid, for example air, is fed through a passage of a nozzle body, flows in a laminar state around a working fluid straightening member, and then passes through tornado-stage fluid slots and is discharged in a tornado shape vortex at the nozzle outlet. A vacuum is produced when the working fluid is discharged from the nozzle outlet, and a fluid to be atomized is drawn through a passage in the straightening member by this vacuum and is atomized together with the working fluid in a tornado shape at the nozzle outlet. The nozzle bore can be larger than in conventional nozzles.

7 Claims, 7 Drawing Figures

NOZZLE FOR ATOMIZING FLUIDS

This application is a continuation of U.S. Ser. No. 403 741, filed July 28, 1982, now abandoned.

FIELD OF THE INVENTION

The present invention relates to a tornado generating nozzle capable of atomizing and gushing liquid fuel, oil paint liquid or particularly water paint liquid, agricultural chemical liquid, extinctional water and the like, and uniformly spraying mud-dredge of cast facings, plaster, mortar and the like, and suspension firing of slack coal, and diffusing and sprinkling metallics, gold powder, silver powder, agricultural chemical powder and the like. DR

DETAILED DESCRIPTION

Figure 1:
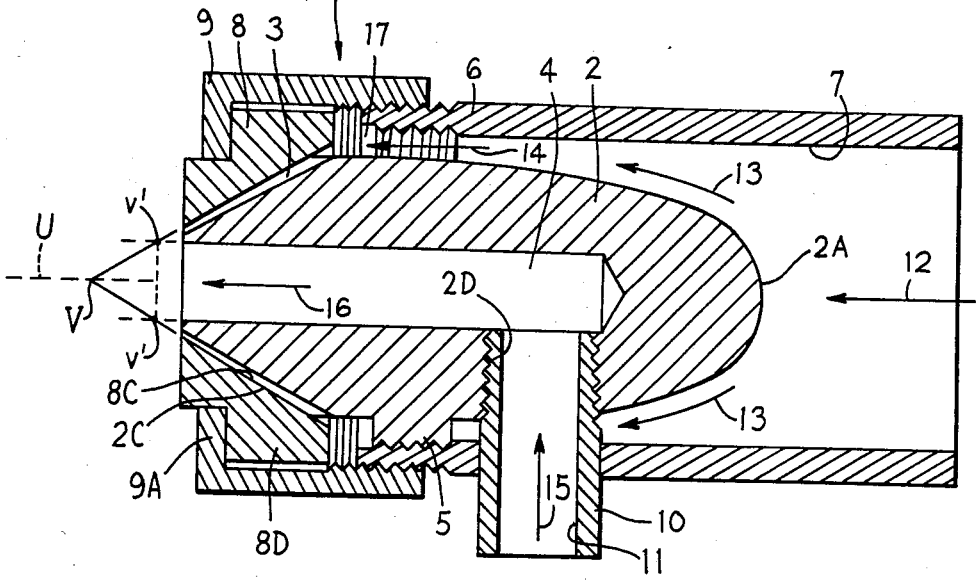
FIG. 1 is a sectional side view of a nozzle which embodies the present invention.

Referring to FIG. 1, a nozzle (1) has a nozzle body which includes a cylindrical pipe (6), a nozzle end cap (8), and an end cap retainer (9). The pipe (6) has a central opening (7) therethrough, is internally and externally threaded at one end thereof and has an opening (6A) therethrough at a location spaced a small distance from the threaded end.

Figure 2B:
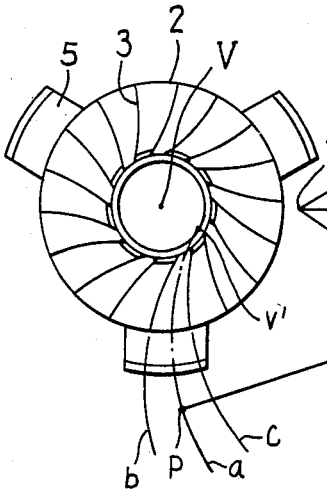
FIG. 2(B) is an elevational end view of the member of FIG. 2(A).

A member (2) is disposed within the nozzle body and, as shown in FIG. 2(B), has three angularly spaced, radially outward projections (5) thereon which each have threads at the outer end thereof which threadedly engage the internal threads on the pipe (6). The surface of the upstream end (2A) of the member (2) is curved and in the illustrated embodiment is an ellipsoid. A generally planar end surface (2B) is provided at the downstream end of the member (2), and the member (2) has a frustoconical surface (2C) which is adjacent and converges toward the end surface (2B). A cylindrical passageway (4) extends coaxially into the member (2) from an opening in the end surface (2B) thereof. A threaded, radially extending opening (2D) is provided in the member (2), and is perpendicular to and communicates with the passageway (4) at the rightmost end thereof. The threaded opening (2D) is aligned with the opening (6A) in the pipe (6), and a fluid inlet conduit (10) having a central opening (11) therethrough extends snugly through the opening (6A) and has an externally threaded end which is disposed in and threadedly engages the opening (2D).

Figure 2A:
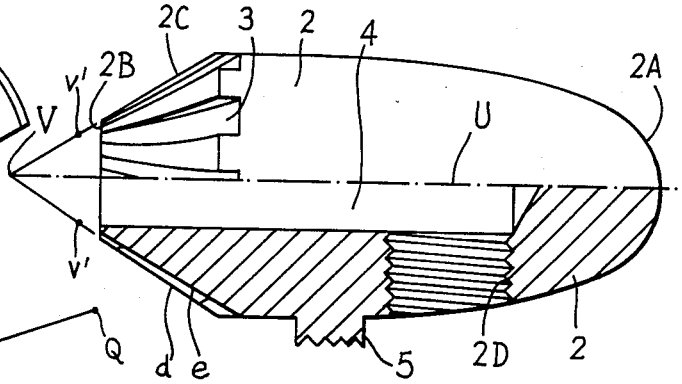
FIG. 2(A) is an elevational side view, partly in section, of a member which is a component of the nozzle of FIG. 1.
Figure 3:
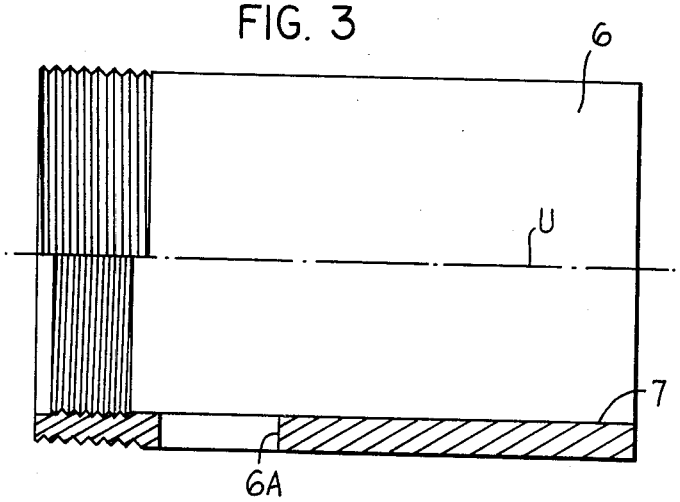
FIG. 3 is an elevational side view, partly in section, of a pipe 6 which is a component of the nozzle of FIG. 1.

The frustoconical surface (2C) on the member (2) has a plurality of angularly spaced grooves (3) therein which, as shown in FIGS. 2(A) and 2(B), each have a bottom wall (e) and two spaced side walls (b) and (c). As shown in FIG. 1, the intersection of an extension of the cylindrical surface of the passageway (4) and the frustoconical surface (2C) is a circle (v′) which lies in a plane substantially parallel to the end surface (2B) of the member (2). The bottom wall (e) and the side walls (b) and (c) of each groove converge toward a point of convergence lying on the circle (v′). As shown in FIG. 2(B), the side walls (b) and (c) of each groove each follow a logarithmic spiral, the center line (a) of each groove being an arc which, in FIG. 2(B), is approximately tangential to the circle (v′) and has a center point (Q) which is closer to the circle (v′) than to the apex (v) of the extension of the frustoconical surface (2C).

Figure 4:
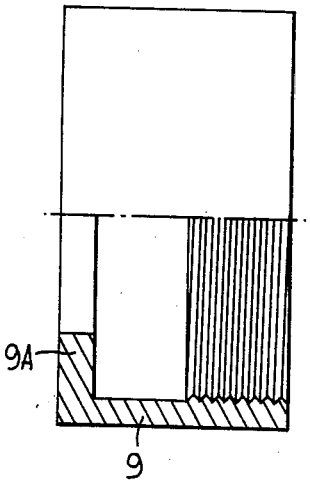
FIG. 4 is an elevational side view, partly in section, of a nozzle cap retainer which is a component of the nozzle of FIG. 1.
Figure 5:
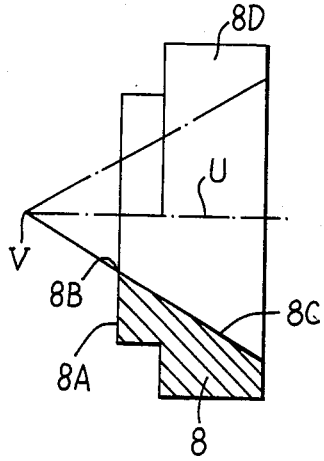
FIG. 5 is an elevational side view, partly in section, of a nozzle cap which is a component of the nozzle of FIG. 1.
Figure 6:
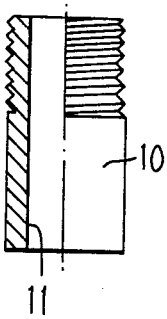
FIG. 6 is an elevational side view, partly in section, of a fluid inlet pipe which is a component of the nozzle of FIG. 1.

As shown in FIG. 5, the nozzle cap (8) has an end surface (8A) thereon with an opening (8B) therein which communicates with a passageway (8C) through the nozzle (8). The surface of the passageway (8C) is a frustoconical surface which converges toward the opening (8B). The nozzle cap has a radially outwardly extending annular flange (8D). As shown in FIG. 4, the nozzle cap retainer is an annular member having internal threads at one axial end and a radially inwardly extending flange (9A) at the other end. As shown in FIG. 1, the frustoconical surface (8C) of the nozzle cap (8) sealingly engages the frustoconical surface (2C) on the member (2), the end surface (8A) of the nozzle cap (8) being substantially flush with the end surface (2B) of the member (2). The threads on the nozzle cap retainer (9) cooperate with the external threads on the pipe (6), and the flange (9A) on the retainer (9) cooperates with the flange (8D) to keep the frustoconical surfaces (2B) and (2C) tightly pressed against each other.

In operation, pressurized air flows through the passageway (7) in the pipe (6) in the direction (12), flows in a laminar fashion at (13) around the ellipsoid surface (2A) on the member (2), and then flows through the grooves (3) and is discharged from the nozzle (1) with a spiral flow pattern. This spiral flow pattern creates a negative pressure or vacuum which causes a liquid to flow in the direction of the arrows (15) and (16) through the pipe (10) and the passageway (4). When the liquid leaves the nozzle, it is atomized by the air flow from the grooves (3).

As shown in FIG. 1, the tornado generating nozzle (1) of this invention, which must be combined with or united to a working fluid rectifier member (2), is mounted within the pipe or gun body (6), an axis of which is coaxially aligned to an axis of the nozzle. When the working fluid (12) (principally pressurize air) flows (13) on a surface of the working fluid rectifier, the working, fluid is then rectified into laminar flow current of a boundary layer, and moreover, while said air current passes through a plurality of groove passages (3) (air current flow groove passages), when the air current causes the strongest powerful and stable potential motion and becomes a rotating air current with a sink power, the said fluid is a tornado-like motion.

In other words, as soon as the liquid on a minus pressure or head is sucked up to a nozzle hole (liquid issue hole), said liquid is gushed and atomized by the rotating air current, and moreover continues stable and gentle vortex motion and advancing motion.

FUNDAMENTAL PRINCIPLE OF GUSHING AND ATOMIZATION (a) The working fluid rectifier member (2), which is shaped as a onesided ellipsoid or a solid of revolution, encourages increased energy of the working fluid as well as flow current velocity on the surface of the rectifier much more if the working fluid flows thereon as a effective laminar boundary layer, by suppressing resistance as low as possible.

A mechanism of a gun (2) (spray gun) must be formed from desired respects by determing a version and dimensions of the gun body, the working fluid rectifier, the tornado nozzle and other elements.

(b) According to this invention, the preliminary factor formulae generating a tornado-like rotating air current (suction type) of a nozzle; are defined as follows:

the equation of free rotating flow: $vr=C_1=\text{constant}$ (a)

at the constant pressure face in free rotating flow: $r^2Z_1=\text{constant}$ (b)

gushing and atomization by the centrifugal force: $f=mr\omega^2=mv^2/r$ (c)

according to formulae (a) and (b), $f=mC_1^2/r^3=(m/r^3)C_2$ (d)

Wherein v is velocity, r is radius of curvature, $C_1$ is an integration constant, $Z_1$ is height, f is centrifugal force, m is mass, $\omega$ is angular velocity and $C_2$ is constant.

(c) Form of the nozzle

As FIG. 2 shows, the nozzle of the present invention is shaped up such that in each groove (3) both walls (b), (c), an imaginary upper surface (d), an existing bottom surface (e) and a center line (a) of the bottom surface must be intersected at a point v' on their respectively extended lines. Said point is named a confluence, and concurrences of a plurality of groove's center lines (in this case, the plurality are applicable for an even number or uneven number) are named a pencil line, which is a circle.

As shown in the orthogonal projection of FIG. 2 (B), a curvature radius (Qv') of the groove should be basically shorter than length (Qv) between a center (Q) of a curvature radius and vertex (V) of right cone frustum of the nozzle.

The curvature radius (QV') of the groove may be considered the less is the more effective, however, if the curvature radius of the groove's number can be determined from design respects, then an imaginary circular cylinder can experimentally be generated.

The (imaginary) phenomenal circular cylinder is a high speed rotating cylinder of hollow liquid membrane shape as mentioned later, and in this situation of the nozzle hole approximates a bore of this phenomenal circular cylinder, unless any exception is specified.

(d) Action of gushing and atomization

The working fluid (12) is emitted as a revolving air current of stable and potential motion conserving a sink such that, when the said working fluid (12) flows on the surface of the working fluid rectifier (2) as a laminar boundary layer, and moreover passes through a plurality of nozzle grooves, it encourages flow velocity and energy to increase.

As shown in FIG. 2, since any confluence points of the nozzle grooves do not intersect to the nozzle's axis, the pencil lines also never gather at a point.

A minimum diameter of said circular pencil line, which will have important elements for the gushing and atomization, can be unconditionally determined if desired respects are given.

Pressure around the minimum diameter of the pencil lines which is generated by the rotating air current becomes the lowest negative pressure, if compared with pressure around the nozzle. On the other hand, the liquid on the minus pressure or head is drawn up to the nozzle hole by the suction of said negative pressure.

At this time the liquid is emitted as a high velocity rotating circular cylinder (16) of a hollow membrane liquid form, and gushed up. (Whereby, the rotating circular cylinder of hollow liquid membrance form is such that, by holding an axis of a rotating circular cylinder horizontal and covering both end sides thereof and pouring a small quantity of water, the membrane of the water is rolled up and adhered uniformly to the inner surface of the rotating circular cylinder by centrifugal force action.)

If the pencil lines come to contact with the tangential direction, (by the centrifugal force action of the rotating air current conserving by the sink force,) the liquid is gushed and atomized by the revolving air current, and furthermore, said liquid continues a very slow and steady tornado motion and a forward advancing motion and goes running ahead.

Since atomized particles and particle groups conserving a revolving force perform rotating flow motion in the range of atomization, withstanding peripherical resistance, as a state of a ellipsoid solid of rotation and in a state as a spheroid, loss of said particles by way of spattering or half-way dropping or the like is considered as lowest. For these reason, the luster of adhered articles appears fresh.

In case of spraying an object, said particles uniformly intrude into and adhere to the surface of the object as a spheroid state without separation of particles, in other words the luster of the surface appears brilliant and fresh.

Hence, if a perfect flow current liquid follows a free rotating flow, the foresaid equation (a) as below is employed, $$vr=C_1=\text{constant} \quad \text{(a)},$$

wherein, the flow velocity v is in inverse proportion to the radius of curvature r.

Accordingly, the flow velocity increases hyperbolically as the rotating air approaches the center of rotation, and at the center point the said velocity increases infinitely, but on the other hand the pressure decreases infinitesmally, so that at this neighborhood the pressure is indicated a negative value.

Wheras, since said negative pressure does not exist lower than zero of complete pressure, at this neighborhood the flow current does not actually exist, therefore at this time a vacant hole is shaped. (As results of an experiment, even if the pencil lines were concentrated at the neighborhood of the center, atomization did not occur.)

The said vacant hole is a kind of free face of the hyperbolic face, which at the neighborhood of rotation center is an equipressure face, equal atmospheric pressure and is filled with the atmospheric air whereby on the equi-atmospheric face an equation is defined as follows;

$r^2 Z_1 = \text{constant}.$

Consecutive phenomenon, such as water vortex tornado wind appearance or rolled-up water column are proper cases enough to observe this invention.

The centrifugal force f used for the atomization is obtained in accordance with (a), (b), and (c) by related formulas as below.

$$f = mr\omega^2 = mv^2/r = mC^2/r^3 = (m/r^3)\, C_2$$

AS REGARDS THE CONVENTIONAL TECHNOLOGY

The present invention relates to apparatus for gushing and atomizing of liquid fuel, oil & water paint liquid, agricultural chemical liquid, extinctional water and the like, and uniformly atomizing of mud-dredge of cast facings, plaster, mortar and the like, and suspension firing of slack coal, and diffusing & sprinkling of metallics, gold powder, silver powder, agricultural powder and the like.

In the conventional invention atomizing methods for liquid and the like by spray type nozzles which have been published, the methods are generally classified in three paragraphs (a), (b) and (c) as follows.

(a) Nozzle and Apparatus which are provided with grooves having a sink of zero and defining straight rectilinear air current passages in the conical surface of the right cone frustrum.

These conventional nozzles provided air pressure of high pressure because of atomization by high speed air current, whereby a diameter of a nozzle hole is restricted to less than 3 mm.

In regard to air current jetted from the nozzle's grooves, since the sink of said air current is zero, even if it is rotating current, the rotating speed of the air current is decreasing the more the air current approaches nearer to the center, when the rate of splashing and reflexing of atomized particles become much still higher.

(b) A further nozzle and apparatus is provided with a constant angular velocity or similar helical air passages on the circular cylinder surface or the conic surface of right cone frustum.

The nozzle depending on a circular cylinder or right cone frustum, where the sink is zero even if the working fluid caused the rotating air current, can be observed in accordance with the foresaid paragraph (a).

Particularly, in case of the nozzle with the right cone frustum, as the working fluid flowing in the nozzle grooves is approximated closer to the vertex of the right circular cone, proper rotating air current is forced uneffectively to work by lower and rectilinear air current, in which an angle of torsion of the nozzle groove is made in low-patch.

(c) As regards a further nozzle, for example that in British Pat. No. 1 459 097, in order to provide an understanding of the contents of the dipole nozzle, the basic limitations of claim 1 of such British patent are set forth in the following paragraph.

A gas-atomizing nozzle comprising a longitudinally extending liquid passageway terminating in a liquid orifice in an end wall of said nozzle, and a plurality of converging gas passages which are delimited by grooves in a tapered solid of rotation as defined herein and a cover shaped to fit over said grooves and which terminate in orifices spaced radially from and arranged symmetrically about said liquid orifice, wherein said converging gas passages reach in the form of less than one turn of a helix, which helices would if extended converge at a focal point lying on the axis of said longitudinally extending liquid passageway beyond said liquid orifice, which focal point coincides with the imaginery apex of said solid of rotation, and of such a shape that, when projected onto a plane perpendicular to the axis of said liquid passageway, the projections of the edges of each groove correspond to the shapes of a selected pair of stream lines directed towards a sink of a hydrodynamic dipole, said sink coinciding with said axis at said focal point.

Furthermore, a few similar types of nozzles with a sink action will now be discussed.

Since such kinds of nozzle depend on the basis that, when doublets of combination of a sinking and source approach an origin, namely a distance of the sink from the source approaches infinitely closer to zero, the sink force becomes maximum, while the right cone frustum of the nozzle is approaching to the circular cone at its extremity, and said right cone frustum must keep the combination of the sink and source. In this case, if the wind pressure, wind speed, wind volume or the like is respectively minimized, the performance of gushing and atomization results in the most effective efficiency. On the other hand, this theory does not exist, because grooves or holes of the nozzle approach to zero.

Furthermore, liquids to be gushed and atomized, which mostly can not be easily gushed owing to the small-size of the nozzle, are viscous and incompressible liquids. If a liquid flux hole is provided to the nozzle, the nozzle is not of a circular cone, but must be a right cone frustum truncating the vertex of the circular cone. In addition, there does not exist the dipole nozzle based on the right cone frustum.

Whereas, since, if observing performance of said dipole nozzle, said nozzle misses important minimized criteria for the sink and source to perform the essential functions, another type nozzle must be required.

Accordingly, as a diameter of the nozzle such as 1 mm, 2 mm and etc. is enlarged, the less the performance thereof becomes.

Finally, it is concluded that if the fluid is atomized at the neighborhood of the focal point, an advancing direction of the center line of the nozzle grooves is an important element for the sink and the source in a negative of a positive side of the nozzle's focal point, and at this time, if this procedure is mistaken, even if high wind pressure, high wind velocity or a high wind volume condition is given, the sink does not appear and moreover inversely the source occurs when the sink is zero.

AS REGARDS THE NOZZLE AND APPLICATION OF THIS INVENTION

A. Nozzle of this Invention

The diameter of a conventional nozzle hole is typically less than 3 mm, and for gushing and atomization high wind pressure, high wind velocity and high volume wind are needed, where the sink is zero.

On the other hand, this invention has been used with nozzles of up to 72 mm, but as results of these experiments it was observed that the nozzle diameter of up to 100 will be performed.

More particularly, in this experiment the nozzle is applicable for situations of low wind pressure, low wind velocity and low wind volume.

| (Test example) nozzle hole (mm) | (clear water is used as the experiment liquid) blower ($mH_2O$) | compressor ($kgf/cm^2$) | Head of liquid level (cm) |
|---|---|---|---|
| 0.5~20 | 0.2~2 | | −100~−2 |
| 0.5~20 | | 0.5~4 | −450~−5 |
| 2.0~70 | | | −5~−1 |

The experiment showed the high efficiency when the nozzle hole is 0.5 mm, the compressed air pressure 2 $kgf/cm^2$ and water level head of the used liquid is minus 450 cm, namely the suction power is 450 cm.

B. Regards as Application (a) The burning of liquid fuel

In the atomization conventional burners are such types as to be used for the principle of spraying by centrifugal force, jet stream rotary type or the like.

In such conventional nozzles, in which the working fluid is mostly delivered with a high speed air current and the liquid pressure for which is high pressure, on the one side if performing perfect combustion, there is blowing out of secondary air or excessive air, and effective heat energy for the combustion heat or the combustion gases must be unuselessly radiated to the outerside, while on the other side if conserving the high temperature in a combustion furnace a great quantity of fuel must be consumed.

For the combustion of heavy fuel oil, since heavy fuel of high viscosity is difficult to atomize, the heavy fuel oil must be atomized by lowering the viscosity by means of the fuel oil heater, or mixing said heavy oil with light oil. If the air combustion must be sucked, a chimney or blower is used, and since there is a danger of back-fire, it is necessary to provide a stop-valve preventing the fuel oil from natural out-flowing.

Whereas, it has been observed that the conventional nozzle has many troubles from the viewpoints of fire-safety measures.

However, this present invention has resolved the most problems on defects and unsafety conserned with conventional oil burners. Following is a table which shows parts of experiment examples according to present invention. (A spray gun type burner was used.)

Said efficiency is not less than 75% even at lowest valuation. In the case of the kerosene combustion, the flame of this invention generates high temperature combustion which is glowed momentarily from the red heat flame after ignition, and at this time the average temperature of the flame rises to approx. 1400° C.

| | present invention | conventional spray gun |
|---|---|---|
| nozzle's hole diameter for flux liquid | 0.5~72 (mm) | under 3 (mm) |
| fuel atomization air pressure | above 0.02 ($Kgf/cm^2$) | above 2 ($Kgf/cm^2$) |
| fuel air applied pressure | unnecessary | necessary |
| fuel oil head | head minus, sink type | head plus or pressure applied type |
| fuel oil atomization | sink type, revolving air current | sink zero, high speed air current |
| blended oil of large or small molecular weight | most suitable, combustion good | unsuitable, incomplete combustion. |
| necessary air quantity for combustion | sufficiency only for primary air | necessary for secondary air |
| air suction chimney for combustion | unused | used |
| combustion flame | coaxial current revolving diffusion flame | coaxial current unrevolving diffusion flame |
| Combustion speed | revolving and advancing speed, slow | advancing speed of acceleration, fast |
| subsequent burning under combustion of flame in ignition | from red flame to momentarily glow flame | flame color is red, subsequently unchangeable |
| average temperature of flame | approx. 1400° C. | approx. 1000° C. |
| combustion effeciency | above 75 percent | approx. 25 percent |
| back fire | impossible | possible (great danger) |
| natural flowout or drop of fuel oil | none and safety | protection stop valve against oil outflow is used. |
| efficiency of large sized nozzle | ten times more than former | unprecedented |

(b) Spray-Painting

| Experiment Results (Fuel oil; Kerosene) (Average temperature of flame is approximately 1400° C.) | | | | |
|---|---|---|---|---|
| Nozzle (mm) | fuel oil head (cm) | air pressure (mm $H_2O$, ($Kgf/cm^2$) | fuel consumption (l/h) | flame diameter length (cm |
| 3 (mm) | −20 (cm) | 300 (mm $H_2O$) | 0.84 (l/h) | 6 × 18 (cm) |
| 3 (mm) | −10 (cm) | " | 1.46 (l/h) | 10 × 30 (cm) |
| 3 (mm) | −3 (cm) | " | 4.8 (l/h) | 20 × 55 (cm) |
| 22 (mm) | −5 (cm) | 3 ($Kgf/cm^2$) | 66 (l/h) | 40 × 190 (cm) |
| 22 (mm) | −2 (cm) | " | 96 (l/h) | 55 × 200 (cm) |
| 32 (mm) | −3 (cm) | " | 47 (l/h) | 45 × 150 (cm) |
| 32 (mm) | −3 (cm) | " | 66 (l/h) | 60 × 160 (cm) |

In the present invention, light oil, kerosene oil, heavy fuel oil, crude oil and the like can be completey burned by using the inventive nozzle and its apparatus.

Furthermore, it is unnecessary to heat the heavy fuel oil or the like.

The efficiency of combustion can be changed in accordance with the liquid outflow hole diameter of the nozzle, however, experiment shows that the larger the nozzle hole, the higher the combustion efficiency can be.

In the conventional spray-painting, the loss of paints by over-spraying is greater, where it is changed in accordance with conditions of a painted surface, and the loss by splashing or reflecting is approx. 20–40%, and at this time it is difficult to find proper conditions of spraying. Furthermore, there is a disadvantage that the painted surface neither has an original color of paints nor reflects a fresh luster.

The present invention provides a tornado generating nozzle continuously to perform the stable and slow rotating and forward advancing motions to atomize and gush the painting liquid in the negative head by the rotating air current with a sinking action, and thus there is no scattering or reflecting.

The particles conserving a rotating force are closely adhered to the painted panel surface in a spherical state, while rotating and intruding with high speed. For these reasons, the color tone luster of the painted surface appears bright and fresh.

Hence, the nozzle of this invention enables one to spray uniformly an uneven surface or a corrugating plate surface only by single spraying, and furthermore, if a nozzle of a large sized caliber is used, the nozzle will perform more efficiently than conventional nozzles.

Said nozzle is easily handled, and in case of consecutive coating, can be linked immediately with a dissolved paints tank.

| | present invention | conventional spray gun |
|---|---|---|
| nozzle hole diameter to flux paints | 0.5~72 mm | under 3 mm |
| air pressure for dissolved paints atomization | above 0.02 (kgf/cm$^2$) | above 2 (kgf/cm$^2$) |
| gushing and atomization method of dissolved paints. | sink, revolving air current, low pressure | zero sink, high speed air current, high pressure |
| spraying of uneven surface | uniformly finished painting by once spraying only | unevenness of surface is larger and worse color or luster. |
| oily paints, water paint | spraying by both paints suitable | spraying by water paints is difficult. |
| paint film run, transparent paint- | no paint film run good transparent painting | impossible even by oily paint |
| pinhole | pinhole or crack of substrate filled up evenly | formation of pinholes during spray painting |
| paints spray efficiency | above 95 percent | 60~80 percent |
| paint consumption | under hitherto 50 percent | 100% except the loss |
| paint spray efficiency | 2~ to 10 times than former | former efficiency replaced to temporarily 1 |
| paint film luster and color surface | fine and uniform spraying | uneven and worse painting finish |
| hygienics and public nuisance | innoxious and harmless | splash, reflection, factor great, potential harm to a person |

(c) Spraying of the inner surface of a pipe, specially of a small sized pipe.

Conventionally it difficult to spray the inner surface of a pipe, in particular of a small pipe.

The nozzle of this invention is designed so that the inner surface of the small pipe of less than 10 mm, particularly so that a small curved pipe can be easily sprayed and coated.

(d) Atomizing of an agricultural chemical liquid or disinfectant liquid and the like.

In the conventional spray nozzle, from the view point of worker's hygienics, there were many disadvantages such as that splashed and reflected volume was great, and even in case of a little inverse wind, U-turn appearance of particles occurred.

According to the present invention, the particles and the particle group which is gushed and atomized by the rotating air current conserving the sink, regularly continue circulations of divergence and convergence movement, while slowly rotating in the atomizing range of the ellipsoidal shape of revolution by its own rotating force.

In the present invention, more particularly, since the atomizing fluid adhered uniformly not only to the front sides of trees and grasses or branch-leaves, but also the back side or hollows therein, effective disinfection can be performed. The reason for hygienics is because this atomizing disinfection can be performed for a higher tree than 10 mm above the ground, and the U-turn appearance of particles in a little adverse wind will seldom occur.

(e) Atomization of extinctive water

In case of atomization of extinctive water, a flame of air current is prevented from enlarging, because the flame is enveloped by the atomization, therefore, the extinction work can be speedily and properly performed.

(f) Spraying of mud-dredge materials such as cast facings, mortar, plaster, textured finish and the like In the conventional nozzle, the size of the hole diameter is restricted, and therefore it is impossible to spray owing to hole clogging. Meanwhile, the present invention employs a strong atomizing power containing the sink, where there is no danger of hole clogging because the hole size can be alternatively chosen.

The method is effective enough to spray large-size particles or mud-dredge materials of high viscosity.

In case of molding the moldine sand, said nozzle is applicable for spraying mud-dredge materials mixed with black wash in alcohol or clay water of facings.

Moreover, in case of spraying a textured finish by using said nozzle, it is possible to spray cork, saw-dust (sawing powder) or sand. In spraying wall surfaces of a house, it is also possible to spray in large area continually.

(g) Suspension firing of slack coal and the like

In the conventional suspension firing, burner combustion can not be performed unless the dried slack coal is crushed into the state of approx. 200 mesh (a mesh square is approx. 0.074 mm).

Meanwhile, the burner combustion of the present invention can be effectively done for slack and rough grain coal, with which particles of mesh 28 (mesh size, approx. 0.59 mm) is mixed. The essential reason is because slack coal burns on the periphery near to the center of the flame, while rough grain coal burns in the external periphery of the flame. For the reason why the combustion efficiency is higher, the heating power is easily regulated, and can be adjusted to withstand the heat load, so said nozzle is applicable for boilers of thermo-electric power.

(h) Metallics

In conventional metallics, in order to raise the adhesive strength, it is necessary to provide the rough sand blowing on a pre-treated ground surface or grinding work. In this case, it is difficult to give the strong adhesive strength and uniform flame spray coating film when filling or padding blow holes of metal, glass and wood surfaces and cast iron. Meanshile, the present invention has improved such conventional defects. The reason is because the embodiment of this invention can perform the plating of metal, chainaware, glass, wood and the like, or padding and filling of blow-holes of cast iron and uniform metallics on all solid surfaces, where the adhesive strength is very strong, and the metal luster appears very fresh and bright.

(h) Metallics

This atomization is applicable for plating metallic metals, such as tin, lead, zinc, copper, silver, gold, brass, bronze, alminum, cadmium, German silver, nickel, iron, stainless steel, and the like.

According to this invention, the apparatus is easy to operate, the work is done faster, and furthermore, plated layers can be finished uniformly in thicker layers. Since particles of a melting metal containing a rotating force, as in a spherical state, adhered to the plated surface because of rotating motion with high speed and intruding therein, the strong adhesive force prevents peeling-off and the metal luster reflects very clear.

(i) Spraying and sprinkling for black, washing or glowing of metal powder such as gold, silver and the like, and agricultural chemical powder and cast facing materials In conventional spraying, there were many difficult problems. Meanwhile, the present invention enables sprinkling of the surface uniformly without any splashing or reflection because, by rotating and advancing in a stable state, when the rotating flow motion is performed, the powder-like materials intruded and adhered to the object during very slow movement.

What I claim:

1. A nozzle, comprising:

a nozzle body having a generally planar end surface thereon and having means defining a passageway therein which communicates with a generally circular opening provided in said end surface, a portion of said passageway adjacent said opening being a frustoconical surface which tapers toward said end surface;

a member disposed in said passageway, having a generally planar end surface which is approximately flush with said end surface on said nozzle body, having a frustoconical surface thereon which converges toward said end surface thereof and is disposed against said frustoconical surface on said nozzle body, and having means defining a cylindrical passageway which extends into said member from and perpendicular to said end surface thereof coaxial with said frustoconical surface thereon, wherein an apex of an extension of said frustoconical surface on said member lies on an axis of said cylindrical passageway, the intersection of said extension of said frustoconical surface on said member and an extension of the surface of said cylindrical passageway therein being a circle lying in a plane parallel to and spaced outwardly from said end surface on said member;

means defining a plurality of angularly spaced grooves in one of said frustoconical surfaces, each said groove having two spaced side walls and a bottom wall which all converge to a point located on said circle, said side walls each following a logarithmic spiral, wherein a center line of each said groove provided intermediate said side walls thereof is substantially an arc having a center point which is spaced farther from said apex of said frustoconical surface than from said circle; and supply means for supplying a pressurized first fluid to said passageway in said nozzle body and for supplying a second fluid to said passageway in said member, said pressurized first fluid flowing through said grooves in said frustoconical surface and being emitted from said nozzle as a spiral flow which produces a vacuum which causes said second fluid to be drawn out of said passageway in said member and to be atomized.

2. The nozzle according to claim 1, wherein an end of said member remote from said end surface thereof has an ellipsoid surface.

3. The nozzle according to claim 2, wherein said nozzle body include: a pipe having internal and external threads at one end thereof; a nozzle cap disposed adjacent said end of said pipe, having said end surface of said nozzle body thereon, and having a frustoconical opening therethrough, said frustoconical surface on said nozzle body being a portion of the surface of said opening through said nozzle cap; and an annular nozzle cap retainer having an internal thread which engages said external thread on said pipe and having means cooperable with said nozzle cap for retaining said nozzle cap in said position adjacent said end of said pipe; and wherein said member has a plurality of angularly spaced, radially outward projections thereon which each have threads at the outer end thereof which are engaged with said internal threads on said pipe.

4. The apparatus according to claim 3, wherein said member has a threaded opening therein which is approximately perpendicular to and communicates with said passageway therein and which is spaced axially from said end surface thereon; wherein said pipe has an opening therein which is aligned with said threaded opening in said member; and wherein said supply means includes a fluid supply conduit which extends generally radially through said opening in said pipe and has a threaded end which threadedly engages said threaded opening in said member.

5. The apparatus according to claim 4, wherein said first fluid is a gas and said second fluid is a liquid.

6. The apparatus according to claim 1, wherein said grooves are formed in said member.

7. A nozzle, comprising:

an elongate inner member of generally circular cross-section having a cylindrical central passageway extending concentrically thereinto from a first end thereof, said passageway having a substantially uniform diameter over a substantially axial extent thereof, said inner member further having a rounded surface portion on a second end thereof remote from said first end and having a frustoconical surface portion thereon at said first end thereof which converges toward said first end and is concentric to said central passageway, said frustoconical surface portion of said inner member having plural angularly spaced grooves therein which each converge in cross-section in a direction away from said second end of said inner member and which each have a centerline which follows a spiral and contacts a circle defined by an intersection of extensions of said frustoconical surface portion and said passageway of said inner member, each said centerline being approximately an arc and having a centerpoint which is closer to said circle than to an apex of said frustoconical surface of said inner member;

a tubular outer member having therethrough a passageway which includes a cylindrical portion of substantial axial extent and a frustoconical portion which is adjacent and converges away from said cylindrical portion, said inner member being supported within said cylindrical portion of said passageway through said outer member so that said frustoconical surface portion thereon engages and said rounded surface portion is spaced from said frustoconical portion of said passageway in said outer member;

means for introducing a liquid to said cylindrical central passageway in said inner member at a location spaced a substantial axial distance from said first end of said inner member; and means for introducing a pressurized gas to said cylindrical portion of said passageway in said outer member at a location spaced upstream of said inner member and for causing said gas to flow through said cylindrical portion of said passageway in said outer member in a direction toward said frustoconical surface portion thereof, to be guided around said inner member by said rounded surface portion thereon, and to then flow through and be discharged from said grooves.

* * * * *